US006436023B2

(12) United States Patent
Barrus et al.

(10) Patent No.: US 6,436,023 B2
(45) Date of Patent: Aug. 20, 2002

(54) PRINTER CONTINUOUS PAPER DRIVE

(75) Inventors: Gordon B. Barrus, San Juan Capistrano; Moshe Ben-Yeoshua; Saul Gutnik, both of Irvine; Fritz Dietiker, Brea, all of CA (US)

(73) Assignee: Printronix, Inc., Irvine, CA (US)

( * ) Notice: Subject to any disclaimer, the term of this patent is extended or adjusted under 35 U.S.C. 154(b) by 0 days.

(21) Appl. No.: 09/726,639

(22) Filed: Nov. 30, 2000

Related U.S. Application Data

(62) Division of application No. 08/823,086, filed on Mar. 24, 1997, now Pat. No. 5,957,827, and a division of application No. 09/347,325, filed on Jul. 2, 1999, now Pat. No. 6,183, 406.

(51) Int. Cl.[7] ..... B31B 1/88

(52) U.S. Cl. ..... 493/320; 493/323; 493/415; 493/416

(58) Field of Search ..... 493/320, 322, 493/323, 413, 414, 415, 416, 445; 400/616.2, 616

(56) References Cited

U.S. PATENT DOCUMENTS

| | | | |
|---|---|---|---|
| 3,770,264 | A | 11/1973 | Sturman et al. |
| 3,941,051 | A | 3/1976 | Barrus et al. |
| 4,172,592 | A | 10/1979 | Miieller et al. |
| 4,332,193 | A | 6/1982 | Noyes |
| 4,338,088 | A | 7/1982 | Buss et al. |
| 4,358,285 | A | 11/1982 | Tujino |
| 4,504,051 | A | 3/1985 | Bittner et al. |
| 4,597,752 | A | 7/1986 | Muller et al. |
| 4,718,657 | A | 1/1988 | Otter |
| 4,810,239 | A | 3/1989 | Moss |
| 5,074,837 | A | 12/1991 | Blanton, III et al. |
| 5,122,004 | A | 6/1992 | Yamada et al. |
| 5,149,075 | A | 9/1992 | Crowley et al. |
| 5,300,008 | A | 4/1994 | Lee et al. |
| 5,305,068 | A | 4/1994 | Sato et al. |
| 5,354,139 | A | 10/1994 | Barrus et al. |
| 5,358,345 | A | 10/1994 | Damitio |
| 5,358,464 | A | 10/1994 | Funk et al. |
| 5,366,303 | A | 11/1994 | Barrus et al. |
| 5,390,907 | A | 2/1995 | Dole |
| 5,425,694 | A | 6/1995 | Negishi |
| 5,454,559 | A | 10/1995 | Murakami et al. |
| 5,544,966 | A | 8/1996 | Pagiaro et al. |
| 5,605,528 | A | 2/1997 | Larson |
| 5,723,214 | A | 3/1998 | Yamazaki et al. |
| 5,791,794 | A | 8/1998 | Kopp et al. |
| 5,847,747 | A | 12/1998 | Ishikawa |

FOREIGN PATENT DOCUMENTS

| | | |
|---|---|---|
| EP | 98302235.1 | 3/1998 |
| JP | 57/131669 | 8/1982 |

*Primary Examiner*—Scott A. Smith
*Assistant Examiner*—Sameh Tawfik
(74) *Attorney, Agent, or Firm*—George F. Bethel

(57) ABSTRACT

A paper stacker for use with a printer which prints connected sheets that are to be stacked in a folded relationship having a surface for receiving the paper with a frame surrounding the paper that is raised in relationship to the paper in order to maintain paper within the confines of the frame as the frame moves upwardly. The frame is balanced by a constant force spring, and is indexed by optical sensors. The frame includes two adjustable fences for variously sized paper which adjustably moves with paddles to press the paper edges downwardly in the stack. Pinch rollers for driving the paper include low inertia drive rollers formed of a relatively low density plastic material with a pair of idler rollers. To improve stacking, ironing tractor idler rollers iron the tractor perforations, and chains orient the catenary stacking movement.

18 Claims, 9 Drawing Sheets

PRINTER CONTINUOUS PAPER DRIVE

This application is a division of U.S. patent application Ser. No. 08/823,086 Entitled a PRINTER POWER STACKER as filed Mar. 24, 1997 which issued as U.S. Pat. No. 5,957,827 on Sep. 28, 1999 Entitled as amended a PRINTER WITH A POWER PAPER STACKER and a division of U.S. patent application Ser. No. 09/347,325, filed Jul. 2, 1999 Entitled a PRINTER TRACTOR FEEDER AND IRONER; U.S. Pat. No. 6,183,406.

BACKGROUND OF THE INVENTION

1. Field of the Invention

The field of this invention lies within the printer art. More specifically, it lies within the printer art pertaining to printing continuous sheets that can be printed by impact printers such as line printers, or thermal printers, or laser printers. The field is even more specifically directed toward stacking printed sheets on a continuous basis to avoid bunching of the sheets or improper formation of the paper stack after printing.

2. Description of the Prior Art

The prior art pertaining to printers and paper stackers in combination therewith, is replete with various types of printers in combination with stackers. Such stackers, stack printed paper or media on a continuous basis or as multiple forms.

One of the major problems with the prior art is that continuous media or paper is generally stacked in a container that is moved downwardly in order to accommodate an increasing amount of media or paper being stacked. This requires a substantial frame and mechanism in order to support and move a 50 pound stack of media.

Another problem of the prior art is that the driving system for the paper being stacked did not allow for a low inertia highly efficient movement of the paper, such that the printed paper emerging speed was maintained properly as the paper emanated from the printer. This is based upon the fact that the paper acceleration and deceleration during the printing process could not be properly accommodated.

Further problems with the prior art included the fact that once the paper had been delivered from the printer and was being stacked, it could not be properly stacked on a consistently closely stacked relationship at the edges.

A particular problem with regard to matrix type printers is the high rate of printing and the frequent acceleration and deceleration of paper or media by the tractor. The tractor tends to deform the tractor drive openings, holes or perforations. Included and compounded with this problem is the fan fold paper, which due to its production methods has substantial amounts of deformity even without printing thereon. This can be true even when it is unfolded and refolded again. The deformities tend to cause a paper stack that is higher on its edges than in its center.

In the prior art, it was known to move a 50 pound box of stacked paper. However, this was done on a poorly balanced overdriven basis.

Further deficiencies of the prior art were such wherein the perforation holes, or openings that were used for engagingly driving the paper, by the tractor, were not oriented such that when superimposed upon each other they allowed for stacking without curving the edges of the stack. Certain tents and bases were used to minimize the effect of the stack being piled up at a higher point due to the tractor perforation holes, or openings. However, the problem was never adequately solved and misfolds and kinks tended to occur. This in some measure was the result of the force of the tractor against the holes which caused a deformation, and raising of the edges surrounding the holes.

Other problems of the prior art were associated with the fact that the paper throat or trough leading from the printer did not properly allow for minimum movement or maximum movement within a range of printed paper emerging speeds and single form one at a time movements. Also, the stacking formation as the paper was folded downwardly was not accommodated by a positioning with a low inertia directional accommodation as the paper oscillated backwardly and forwardly during stacking.

Other drawbacks of the prior art included the fact that there were no suitable adjustable fences for accommodating various sized paper so that a combination low inertia drive and adjustable fence could maintain proper stacking over the range of various paper feed speeds.

This invention has overcome the deficiencies of the prior art by providing for a surrounding frame with a basket which rises as paper is being stacked. Pinch rollers, flexible paddles, and fore and aft fences maintain a constant height with respect to the top of the stack. This allows for maintaining an optimum geometry for each sheet of paper or media entering the stack independent of the overall stack height.

The pinch rollers comprise low inertia drive rollers that are driven by a motor shaft frictional engagement. The drive rollers are capable of rotating at a rate to accommodate maximum print paper emerging speed the or maintaining paper tension.

A spring loaded friction clutch surface between the drive rollers and drive shaft is accommodated by plastic bushing interfaces with rollers that do not slip on the paper. Hence there is limited wearing or relative movement against the paper by the drive rollers. Also, the low inertia drive rollers closely follow the paper's acceleration and deceleration which helps to avoid interference with the paper's normal motion during printing. The drive rollers in conjunction with idling rollers that are spring loaded against the drive rollers accommodate various paper widths and thicknesses.

As the paper falls to the top of the stack, flexible paddles in conjunction with fore and aft fences accommodate the paper so that it is driven downwardly into a neat and properly indexed stack. This stacking effect by the flexible paddles with the fore and aft fences maintains a neatly indexed stack that is contained within the general framework of the stacker which moves up as the paper is being stacked. The paddles serve to drive down the edges of the paper at the perforated fan folds for closely oriented paper overlaying at their edges.

In order to avoid mechanical imbalances, a constant force spring counterbalance is utilized to overcome the friction of the frame as it moves upwardly and downwardly. In case of a power failure, the frame stays in position without collapsing on the stack due to the constant force spring. This particular counterbalance also allows the frame to be raised and lowered manually. Furthermore, the frame can be positioned at various positions and maintained with a minimum of drive effort due to the constant balance provided by the constant force spring.

An additional feature of this invention is that the tractor perforation holes in the paper are ironed by idling rollers located at the exit of the tractors. Any deformation of the tractor perforation holes can cause increased stack height at the edges due to any hole deformation and create a concave stacked top which increases kinks and increased locking at the perforations. The idling ironing rollers of this invention help to overcome this.

The flexible paddles are provided to rotate on the paper's edge at the perforated fan folds. These help to fold the paper by pulling the paper against the fore and aft fences and compressing the stack at the edges which helps to maintain the top of the stack flat.

A paper throat or trough leading from the printer facilitates paper feeding and loading at the start of a printing job. This loading is enhanced based upon the pinch rollers that open due to the idling rollers moving from the driving rollers at an uppermost stacking position to allow loading of the paper.

The paper as it is being folded and delivered downwardly is guided through a series of guides and fences. One of the guides comprise hanging chains which tend to maintain the paper in a generally loose but slightly weighted catenary formation to allow it to stack properly.

The adjustable fore and aft fences help to contain and position the stack. This also helps in conjunction with the paddles previously mentioned to fold the paper at the fan fold edges. Both fences are coupled to one another through a cable pulley system which places the fences equidistant from the paper throat for all paper lengths from 5 to 12 inches. Attachments of the fence to the frame places paper alignment surface adjacent to the top edge of the stack allowing a short fence which can be readily moved out of. the way for stack removal.

The adjustable fore and aft fences each have a set of infrared beam sensors. The infrared beam sensors are located at the paper's edge. Whenever the paper stack interrupts the beams, the frame is elevated to maintain a constant height with respect to the top of the paper stack. A time span after the sensors sense movement accommodates the paddles moving through the sensors and false movements so that movement doesn't take place until sensing occurs over an extended period of time. These beams further help to orient the frame. When it needs to be lowered, over an existing stack, the frame descends until the beam is interrupted which fundamentally means that the frame is in proper relationship to the stack. Since the sensors are attached to the fences they are placed in a fixed position relative to the edge/fold of the paper for various length paper in a coordinated manner.

In order to provide a positive movement of the travel of the paper, paddles are activated in anticipation of any frame movement and feeding of the paper. They continue to be activated for some time after initial startup to maintain the paper tension and eliminate any slack in the paper.

A paper motion detector is also utilized to determine paper movement as well as means to show whether the paper is properly moving in the paper trough or throat. In this manner, whenever paper is being printed, and there is an obstruction at the paper throat, the system declares a fault thereby stopping the printing function and avoiding data loss. A paper in detector (i.e. in the trough) assures that this fault is not declared if there is no paper in the throat area that has been printed, as is the case when printing the initial few pages of a box of paper.

From the foregoing description of the improvement over the prior art, it can be seen that this invention is substantially an advancement over the art.

SUMMARY OF THE INVENTION

In summation, this invention provides a moveable paper guide and frame stacking mechanism having adjustable fore and aft fences that accommodate various paper sizes, and which ascends as the paper stack height increases and provides limit controls while at the same time providing paper tensioning pinch rollers with a positive drive, and furthermore has paddles to orient the paper.

More particularly, the invention provides for a frame which rises as the paper is being stacked, and has pinch rollers to feed the paper. The pinch rollers comprise drive rollers of a low inertia type of roller formed and supported on a drive shaft with a friction washer structure. The drive rollers are capable of rotating faster than the maximum printed paper emerging speed to maintain the paper constantly in tension.

Incorporated with the drive rollers is a friction clutch at the friction washer bearing interface to allow a driving without affecting the paper adversely. This compensates for paper acceleration or deceleration thereby avoiding interference to the paper's normal motion during printing. The pinch rollers include idling rollers that are spring loaded against the drive rollers. The idling rollers open at the uppermost position of the frame to allow paper loading through a pivotal, or bell crank mechanism.

A further enhancement are the flexible paddles that can be adjusted with fore and aft fences to accommodate the paper being stacked so that it lays down in a uniform manner at the edges, and have coordinated movement with the fences.

The pair of constant force springs which counterbalance the structure provide for improved mechanical movement. This allows the elevator motor to overcome the friction in the movement of the frame on its supports without having to substantially undertake the sole lifting weighted movement thereof.

In order to allow for the tractor perforations or holes to be stacked on top of each accurately, a pair of idling ironing rollers iron the edges and the tractor perforations to reduce tractor drive hole deformations. This helps to overcome stacking problems by substantially eliminating the increased height where the tractor perforations underlie each other. The ironing rollers are positioned proximate the tractor for guidance of the paper from the tractor and subsequent ironing by the rollers.

The paddles rotating at the paper's fan folded edges help to fold the paper at the creases and compress the stack thereat.

Chains hanging down against the paper in the form of its catenary stacking movement help to direct the paper properly and maintain a degree of slight tension. This in conjunction with the fore and aft fences and the paddles help to contain and position the stack to fold the paper at the fan fold perforated crease line.

In conjunction with the fore and aft fences of the frame a set of infrared beam sensors on each fence orient the frame with regard to the paper stack. Whenever the paper stack interrupts either beam, the frame is elevated to maintain its height with respect to the top of the stack. These beams also help to position the frame so that the frame when lowered over an existing stack can go down to the proper level or when being raised can go to a proper height. However, movement does not take place until a continuous sensing has taken place to accommodate a single sheet of paper or paddle movement passing through the path of the beam.

The entire foregoing features of this invention enable an enhanced stacking of printing paper forms and media without data loss and interference of the paper feed system.

BRIEF DESCRIPTION OF THE DRAWINGS

FIG. 11 shows a sectional view of the shaft with the drive rollers.

DETAILED DESCRIPTION OF THE PREFERRED EMBODIMENTS

Figure 1:
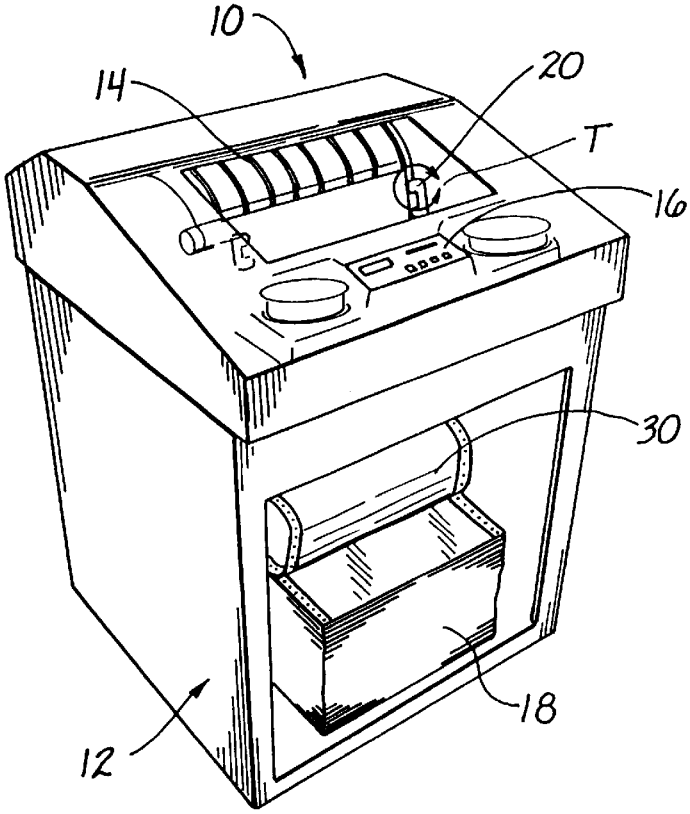
FIG. 1 shows a perspective view of the printer and the paper stacker underlying the printer.

Looking at FIG. 1, it can be seen that a printer 10 has been shown. The printer 10 is generally mounted on a base 12. In some cases, the printer 10 and the base 12 can be integral, or the base can be in the form of a cabinet or stand.

The printer 10 can be a thermal printer, a laser printer, a line matrix printer, or any other type of printer which prints on a continuous sheet of paper or media. The continuous sheet of paper or media is usually folded with sheets into individual sheets in a fan fold manner along a perforated fan fold line. Also, other means of providing the paper in a continuous sheet can be utilized to implement the fan fold configuration.

In the particular embodiment shown herein, a line matrix printer has been shown. The line matrix printer is of the type having hammers in a hammerbank which are released for impinging against a ribbon and the underlying paper or print media. The hammerbank moves backwardly and forwardly as it prints in a high speed manner. This particular invention is particularly adept at handling such high speed printers. Not only are the printers of a high speed type but they are of a heavy duty type undertaking heavy print cycles which can be quite extensive as to time, speed and overall job performance. The types of printers referred to as line dot matrix printers herein, which this invention is combined with, are described in such U.S. Patents as, U.S. Pat. No. 3,941,051, U.S. Pat. No. 5,354,139, and U.S. Pat. No. 5,366,303 which are incorporated herein by reference.

The printer 10 incorporates a wire form feed or paper guide 14 which allows the paper to travel in a uniform manner over a drum. The paper travels between the wire form or guide 14 and the drum.

A control panel 16 is shown having a series of printer controls that are known in the art. The controls can be such where they turn on the printer, advance the paper, stop it and undertake numerous other functions in conjunction with the printer and any host or related computer.

Underlying the printer 10 within the cabinet 12 is the blank paper 18. The blank paper 18 is generally a series of stacked fan folded sheets 30 which are to be printed upon by the printer 10. The fan folded paper 18 is continuous and perforated along the fan fold edges for easy folding and stacking. In order to drive or advance the paper 18, a tractor shown as tractor 20 is shown as encircled in FIG. 1 by circle T. The tractor 20 is detailed in FIGS. 2, 2A and 2B.

Figure 2B:
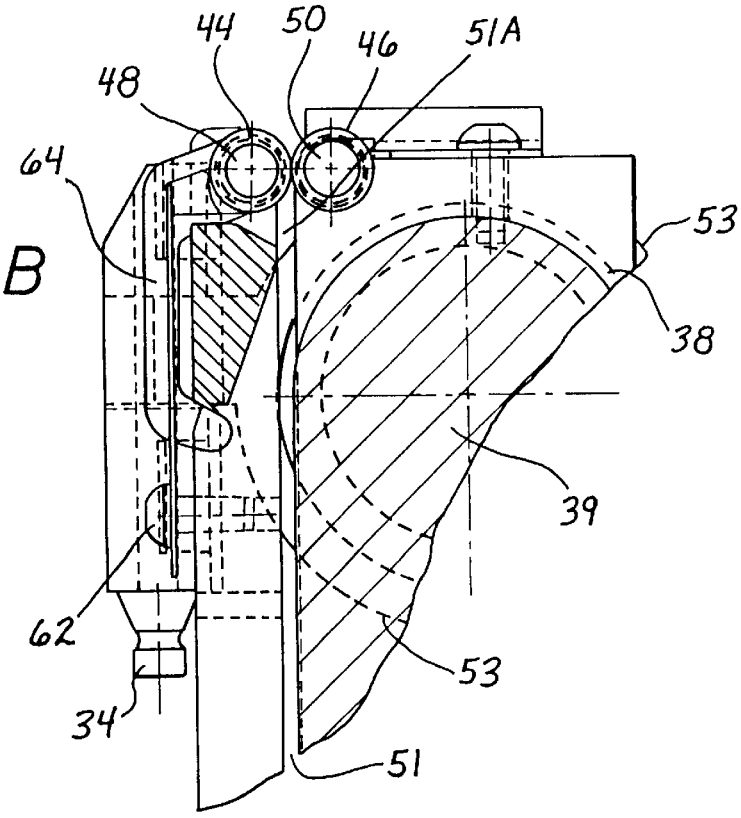
FIG. 2B shows a cross-sectional view of a fragmented portion of the tractor along lines 2B of FIG. 2.
Figure 2:
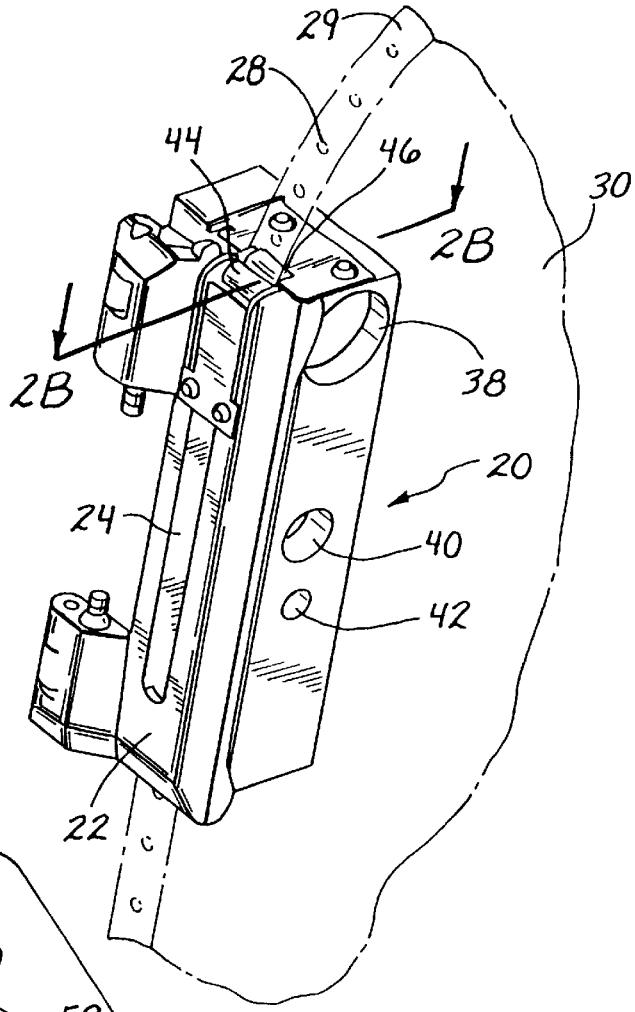
FIG. 2 shows a perspective view of a tractor that has been circled within circle T of FIG. 1.
Figure 2A:
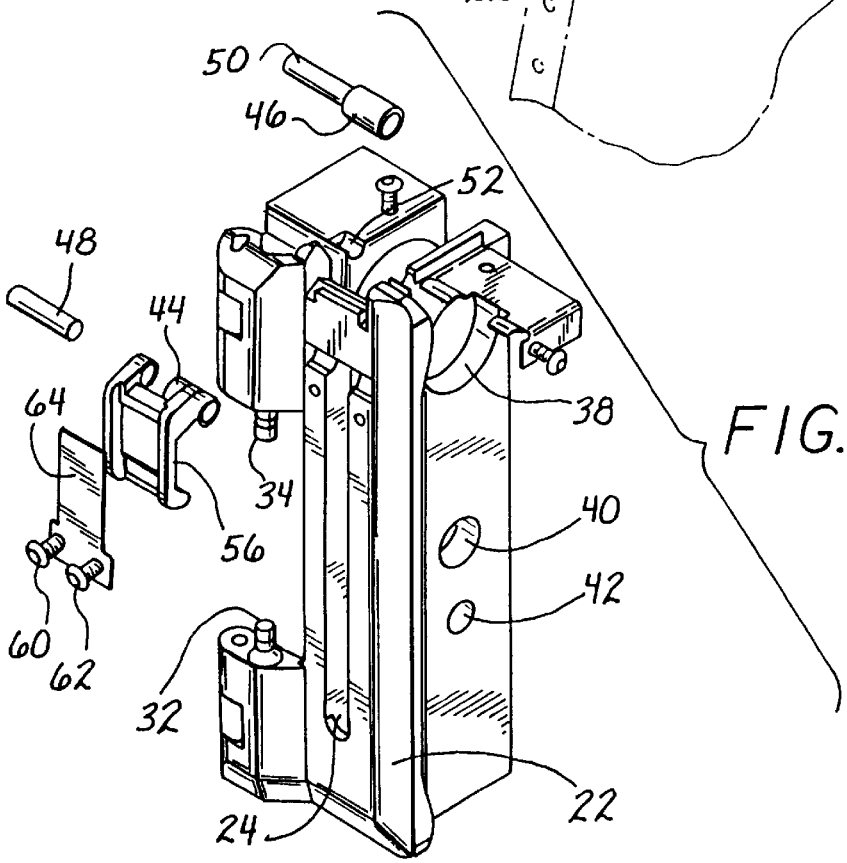
FIG. 2A shows an exploded view of the tractor.

Looking more particularly at FIGS. 2, 2A and 2B, it can be seen that the tractor 20 is shown with a spring loaded hinged cover 22. The spring loaded hinged cover 22 has a slot 24 which provides for the pins of the tractor 20 to drive or advance the enlarged punched out tractor perforation holes 28 of a sheet of paper 30 driven from the continuous stack of paper 18. The hinge points on hinge points 32 and 34 allow the hinged cover 22 to be opened and closed to provide feeding and access of the paper 18 with the tractor punched out perforation holes 28 over the pins of the tractor.

In order to drive the tractor 20, a splined shaft opening 38 is provided to drive the tractor by a splined shaft 39 which is seen in FIG. 2B. The splined shaft 39 is known in the art for turning tractors 20 to move the paper 18 with the tractor perforations 28.

Two openings 40 and 42 are provided to allow for attachment respectively of the tractor 20 through a screw means passing through opening 40 or other means, and a tension adjustment of the tractor through opening 42.

Looking more specifically at the upper portion of the tractor 20, where the edges with the tractor perforations 28 of the paper 18 exit the tractor, it can be seen that a pair of rollers or cylinders 44 and 46 are shown. These respective rollers or cylinders 44 and 46 are such where they are made of plastic cylinders but can be of any other material such as stainless steel.

Preferably, the plastic cylinders 44 and 46 are made of a plastic material suitable for bearings having a high temperature resistance, high load capacity, high wear resistance, low friction and electrically isolating properties for static dissipation. Excellent results have been obtained using a thermoplastic alloy having a network of special fibers and permeated by solid lubricants. One such preferred alloy is T-500 Iglide (Trade Name) manufactured by Igus Inc.

Other plastics which can be used include among others, nylons, polystyrenes, acetal copolymers, polycarbonates and polysulfones. The addition of conductive carbon or graphite fibers, or metal fibers such as aluminum provide static dissipation as well as increased tensile strength and wear resistance. Lubricants such as fluoropolymers such as polytetrafluoroethylene (PTFE), molybdenum disulfide or silicones can also advantageously be added.

The rollers 44 and 46 idle on two shafts 48 and 50 respectively. These shafts 48 and 50 are mounted on the tractor 20 by press fitting, a friction fit, or can be affixed in any other suitable manner. Shaft 50 is mounted on the tractor body 20 within an opening 52, while shaft 48 is mounted on a spring loaded pivoting or lever member 56 mounted with two screws 60 and 62 to the tractor body 20. A spring member or bail 64 is shown driving the lever or pivot member 56 inwardly toward the opposing roller 46. Thus, as the bail or spring 64 biases the roller 44, it is pushed against roller 46, to nip the paper 18 so as to secure it and tightly iron the tractor perforations 28. The tractor perforations 28 are higher than the thickness of the paper thereat inasmuch as they have been punched out and driven into an embossed form. In ironing the perforations 28, the edge region 29 of the paper is flattened so that the tractor perforation edges when stacked in a fan fold relationship over a series of perforated sheets of paper 30 does not build up an excess amount beyond the level of the paper sheets 30.

The perforations that need to be ironed are not only formed during the punching out and embossing of the tractor perforation holes 28, but are enlarged due to the fact that the tractor wrenches and moves the paper in a high u g 16 acceleration and deceleration mode. This oftentimes enlarges and opens the tractor perforation holes 28 to the extent where they are deformed and enlarged due to the fact that the tractor 20 engages the edge openings and pushes them upwardly. It is this engagement and pushing upwardly of the edges of the tractor drive holes 28 which causes an enlargement and raising of the area so that stacking of the paper is such wherein it is raised when the holes 28 overlay each other. It is for this reason, that the ironing features of this invention are an improvement for proper stacking and orientation of the paper sheets 30.

It should be appreciated that the rollers 44 and 46 are idler rollers that are journaled on the shafts 48 and 50 and are not driven as in the prior art. With the low friction material of which they are made, they idle freely on the shafts 48 and 50 to provide low friction free running movement. In this manner, they are able to travel with the respective speed of the paper 18 passing therethrough without overdriving or underdriving the paper. This not only improves the tractor 20 operation, but the subsequent drive and stacking functions of the entire power stacker of this invention.

Looking more particularly at FIG. 2B it can be seen that a gap or channel 51 has been shown. This gap or channel 51 allows the paper 18 passing therethrough to be driven by the tractor which is shown having an outer peripheral drive spool or spindle 53 which is shown without the tractor belt having the upstanding pins or triangular protrusions that engage the openings 28. The showing is such where it shows the tractor drive wheel or spindle 53 without the tractor belt and pins that engage the openings 28. These openings 28 as previously mentioned pass upwardly along the slot, channel, or opening 24.

The distance between the engaging tangent relationships of the rollers 44 and 46 is such that the paper passing through the tractor that extends over spindle 53 should engage the paper in close proximity to where it emanates from the tractor drive. This is so that the paper will not crumble or compressively deform in the channel 51 and specifically that area 51A which is shown between the periphery of the tractor spindle upon which the tractor belt moves and the nip point or point of tangency where the two rollers 44 and 46 make contact. In effect, the distance of the rollers should be in adjacent or proximate relationship to the spindle of the tractor or the position from which the paper emanates off of the tractor drive. Depending upon the thickness of the paper, and the attendant relative compression which the paper can receive before it buckles, the distance can vary along the channel 51A between the tractor paper delivery end point and the nip point of the rollers 44 and 46. This can be determined by experimentation depending upon the paper thickness, or media being used. It should be understood that gap or channel 51 and portion 51A of the gap provide a specific channeling action. This channeling action between the point where the paper emanates from the end of the tractor and passes through the nips or tangency of the rollers 44 and 46 should provide a guide. In effect, the channel or guide 51A is an important function depending upon the proximity of the rollers 44 and 46 to where the paper emanates from the last driven position from the tractor.

Figure 3:
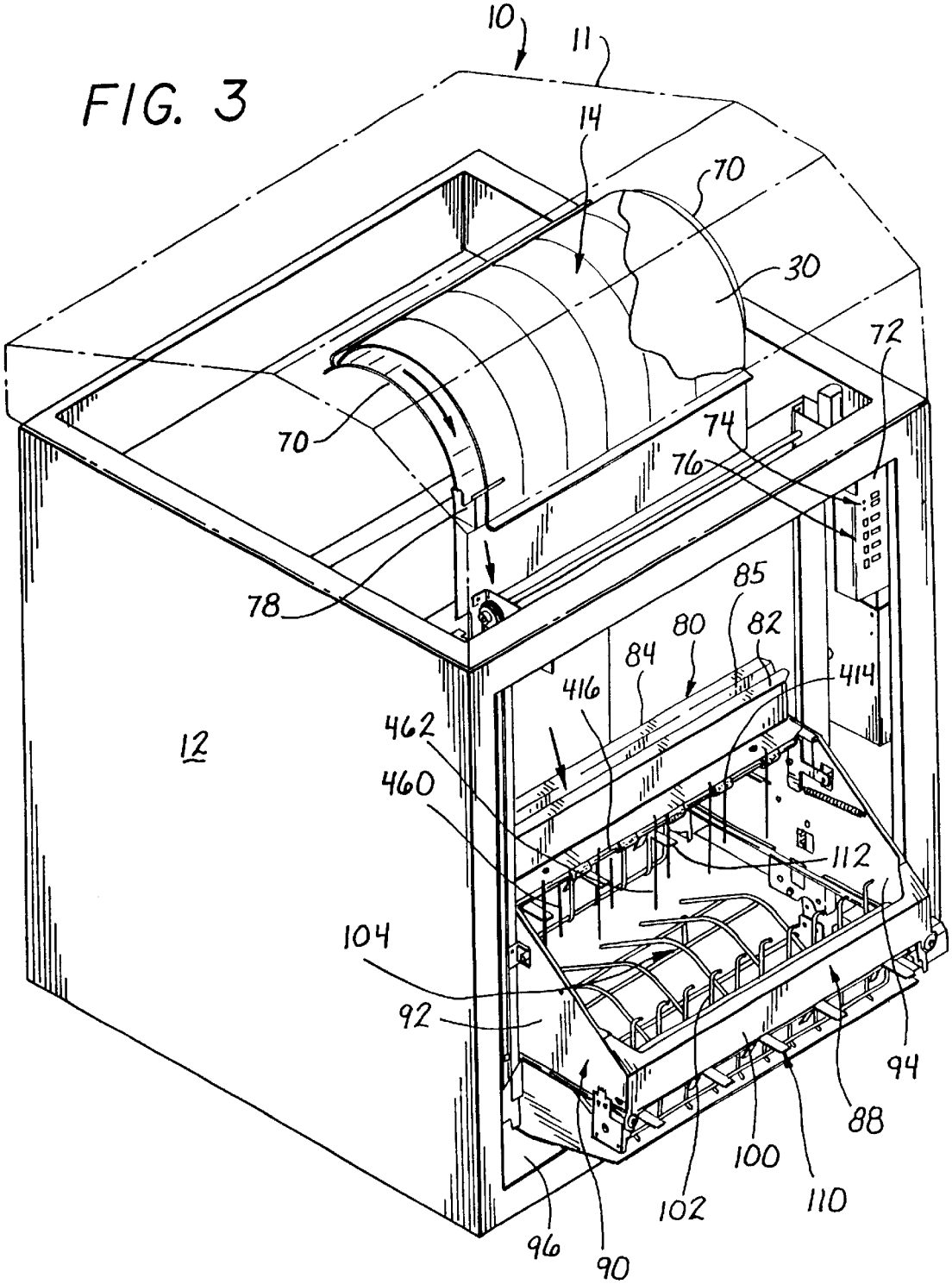
FIG. 3 shows a perspective view of the paper in the printer and the paper stacker of this invention.

Looking more particularly at FIG. 3, it can be seen that the printer 10 with the cabinet 12 is shown with the wire form 14. The wire form 14 is shown with a number of wire strips that are bonded together to form a wire overly. This serves to hold the continuous paper 18 as shown traveling over a paper path drum 70. The paper path drum 70 underlies the paper as it travels, while the wire form 14 keeps it traveling in a downward direction as shown in the direction of the arrows.

A printer cover 11 is shown covering the printer which can be lifted off in order to access the various portions. A control panel 72 is shown having indicator lights 74 and control function switches 76. The control functions of the switches 76 provide for the stacker to move upwardly and downwardly as well as to provide for feeding the paper 18 and to place the printer on line so that it is prepared to print.

The further showing in FIG. 3 details a wire form resting ledge 78 which supports the wire form 14 thereon and a trough or throat 80 underlying the wire form. The trough or throat 80 has an opening 85 formed by two spaced elongated converging guide members 82 and 84 which provide a sloped converging throat therebetween in the form of the opening 85. The throat provided between members 82 and 84 can be seen in greater detail in FIGS. 6, 7 and 8 which illustrates their inward sloping function of feeding the paper 18.

A main feature of this invention is the frame, or elevator boundary control and stacking unit 88. The frame 88 comprises two triangular leading edge members 92 and 94.

The frame 88 moves upwardly and downwardly over a base plate 96.

Figure 5:
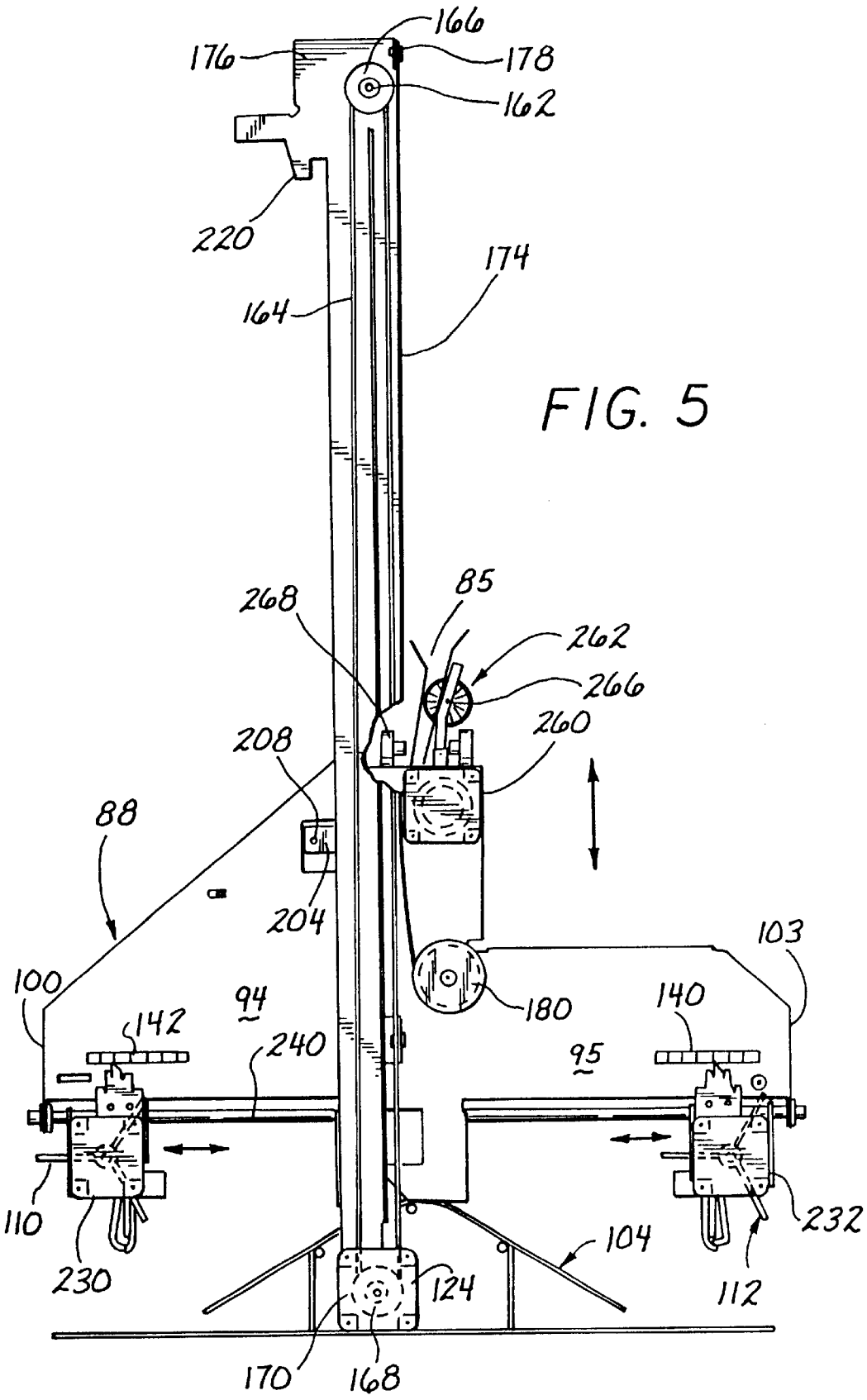
FIG. 5 shows a side elevation view of the paper stacker.
Figure 8:
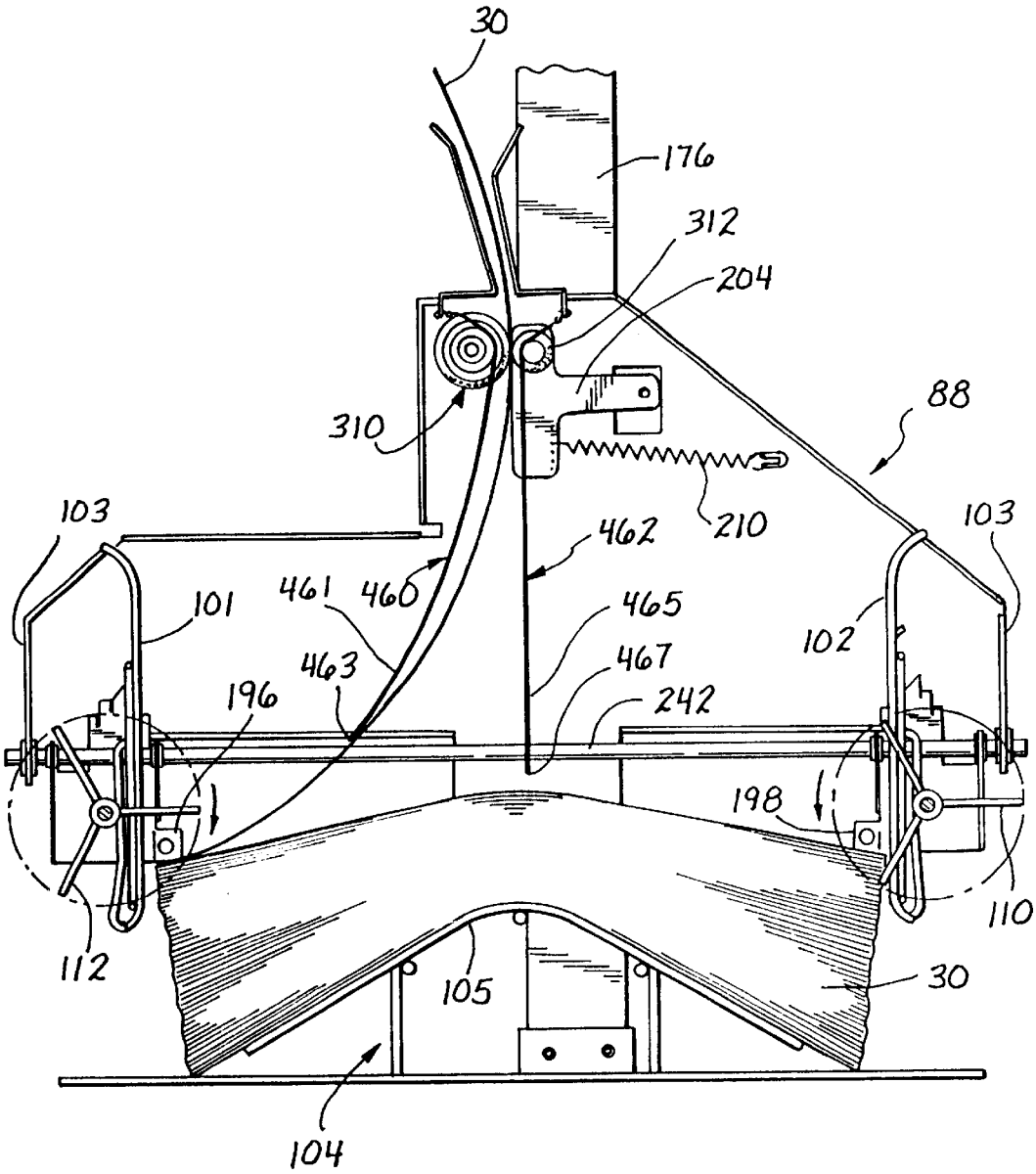
FIG. 8 shows the action of the stacking of the paper with the paddles moving in relationship thereto.

The frame 88 is such where it has a frontal cross member 100 and a rear cross member 103 seen in FIGS. 5 and 8. In this manner, it can secure a pair of fore and aft moving fences, boundaries, or wire stays 101 and 102 or the like. Also, with this particular frame 88, a tent like member formed of wire is shown as an upstanding tent 104 on which the paper can be stacked. This allows the center of the paper sheets 30 as stacked to be above the fore and aft edges or fan fold creases. Further enhancing the operation of the frame 88 as it moves upwardly and downwardly with regard to the paper 18 being fed, are fore and aft flexible paddles 110 and 112 that operate in conjunction with depending chains 460, and 462.

The functions thereof will be detailed hereinafter in the following specification.

Figure 4:
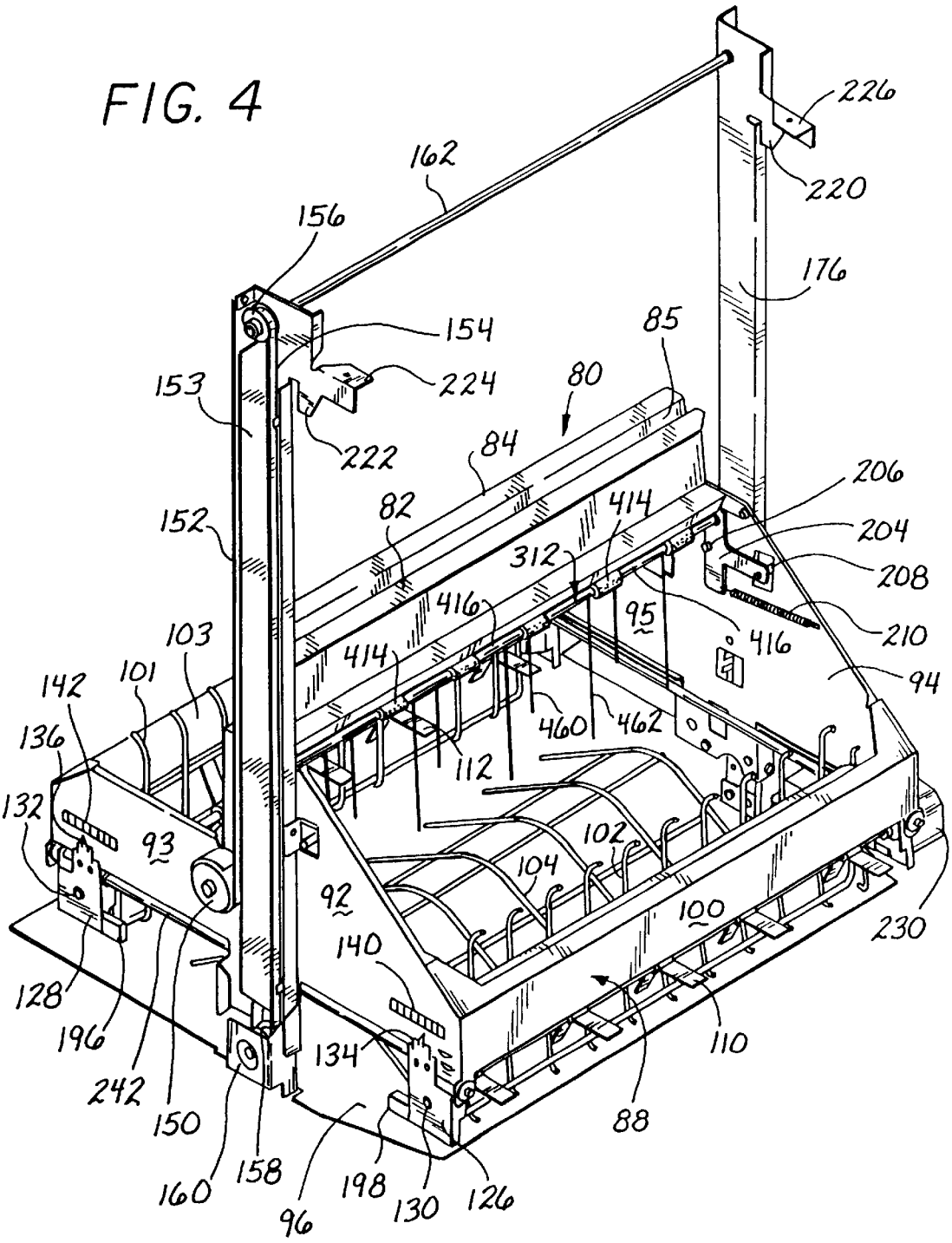
FIG. 4 shows a perspective view of the paper stacker of the invention as removed from the cabinet of the printer.

Looking more particularly at FIG. 4, which shows the frame 88 it can be seen that the forward lateral member 100 and the aft or rear lateral member 103 are shown supporting the triangular edge portions 92 and 94. The triangular edge portions 92 and 94 terminate in extending portions respectively 93 and 95 to create a rectangular form or framework for the frame 88.

In order to turn the flexible paddles 110 and 112, a pair of motor 230 and 232 are utilized, one of which is seen as motor 230 mounted on the far side in FIG. 4 of the frame 88. The paddle motors respectively for flexible paddles 110 and 112 turn the paddles on a shaft that is journaled within bearing holders 126 and 128 that have bearings respectively 130 and 132 in the bearing holders 126 and 128.

The bearing holder 126 has an arrow paper size indicator 134. The indicator 134 functions with a paper indicator length index or scale 140.

The frame 88 is dynamically balanced by a constant force spring that is coiled on a drum 150. The spring is shown as spring 152 connected at its extended end to a stanchion 153. There is a spring on either side providing constant force and balancing to the frame 88. This spring 152 is in the form of a spring steel strip that has been coiled and formed in its cross-section to allow an expansion and contraction around the drum 150 to provide for constant upward and downward force to the frame 88 to which it is attached. Since the spring drum 150 is attached to the frame 88 and expands and contracts with a constant force from the coil, it balances the frame 88.

In order to move the frame 88 upwardly and downwardly on its base plate 96, it is driven by a motorized timing belt 154 that engages a pulley or sheave and a second sheave. The timing belt 154 passes over a second sheave 158 mounted in a bearing housing 160. The drive by the motor is also through a second timing belt and a crosshaft or rod 162 to assure a proper horizontal attitude of the stacking mechanism without jamming as detailed hereinafter.

The timing belt 154 as can be seen looped over the sheaves 156 and 158 is driven by a lift drive shaft, crosshaft or rod 162 that is driven in turn by a second timing belt 164 journaled on sheaves or pulleys 166 and 168. Sheave or pulley 168 is driven by an elevator motor 170.

The shaft, pulleys, and motor 170 to which it is engaged can be seen in greater detail in FIG. 5. corresponding movement of the timing belts 154 and 164 accommodate upward and downward movement of the frame 88.

In order to enhance and balance the movement of the frame 88 on either side, a second constant force spring 174 is shown in FIG. 5 attached to the upper portion of a stanchion 176 by means of a pin or screw 178. The spring strip 174 extends from a second roll or drum 180 analogous to the drum 150. As the spring strip 174 extends upwardly and downwardly it provides a constant force on the opposite side from the spring force provided by constant force spring 152. This is due to the drum 180 being attached to the frame or lateral member 95. Thus, springs 152 and 174 maintain the balance on either side of the frame 88 as it moves upwardly and downwardly.

In order to provide proper indexing of the fence members 101 and 102 with the frame and flexible paddles, a pair of beam sensors 196 and 198 are shown. They serve the function of determining when the stacked paper sheets 30 interfere with the beams. The beams can be infrared or any other optical beam sensors. They also help to establish the frame 88 level as detailed hereinafter. The sensors are positioned just inside the paper stack and above it to detect the top level of the paper sheets 30. After they sense movement, a time span is incorporated to accommodate brief beam interruptions by the flexible paddles, 110 and 112 and single sheet 30 movements. Thus a response does not take place until the beam has been interrupted for a period of time or "de-bounced" for approximately 100 milliseconds.

In order to open the pinch rollers detailed hereinafter, a pivot plate or bell crank 204 is shown on a pivot point or pin 206. The bell crank or pivot plate 204 is biased by a coil spring 210, and has a pin 208 which engages the tops of the stanchions 153 and 176 so as to open the pinch rollers in a manner to be detailed hereinafter.

Looking more specifically at FIG. 5, it can be seen that the pivot member or bell crank 204 when it rises to a particular level engages a bell crank or pivot crank actuator appendage or depending member 220. This is also identical and similar to the appendage or depending member 222 on the stanchion 153. The two respective stanchions 153 and 176 have a shelf member or turned over flange respectively 224 and 226 which support the depending members 220 and 222. They also have openings in order to attach the stacker to a printer in association therewith.

The stanchion 176 is seen with the pulley or sheave 166 attached to its upper portion and the lower pulley or sheave 168 driven by the drive motor 170. This effectively allows the entire frame 88 to move upwardly and downwardly without having to move the printed stack of paper that is being printed on upwardly and downwardly. This is a significant step in the art.

When looking at the showing in FIG. 5, it can also be seen that a pair of motors 230 and 232 are shown. The motors 230 and 232 turn the flexible paddles respectively 110 and 112. These flexible paddles 110 and 112 impinge against the paper sheets 30 as they are being stacked at the fan folds in order to place or wipe them into stacked relationship during the movement of the paper as it is folded downwardly and guided. The motors 230 and 232 are respectively provided with bearings. As previously stated the flexible paddles 110 and 112 are supported on bearings 130 and 132 within bearing mounts 126 and 128. Accordingly, they can turn with uniformity to provide the flexible paddles with rotational movement to force down the paper at the folded edges in the manner seen in FIG. 8. The flexible nature of the paddles is such wherein they turn against the paper sheets 30 to elastically wipe or coerce the edges of the paper downwardly against the underlying stack.

The motors 230 and 232 with their shafts holding the flexible paddles 110 and 112 can be moved fore and aft or inwardly and outwardly for indexing with respect to the index location 140 to accommodate various lengths of paper. The respective paddles with their motors and shafts 230 and 232 are slid along rods or shafts 240 and 242. These shafts 240 and 242 allow for sliding movement of the motors and the paddles along with the fences 101 and 102. The shafts 240 and 242 can be substituted by any other means such as square rods, round rods, rails, or other supports in order to allow for the inward and outward fore and aft movement of the flexible paddles 110 and 112 with their motors and the attendant fences 101 and 102.

In FIG. 5 a motor 260 is shown which is used to drive the pinch rollers and more specifically the drive shaft as described hereinafter. A paper movement detector 262 is spring biased against the paper passing through the throat 85 of the guide trough 80. The paper movement detector comprises a rotatable wheel 266 as part of an optical encoder. As the paper 30 moves against the wheel 266, it rotates and transmits signals that the paper is moving thereover. The paper movement can also be determined as to speed depending upon the optical encoder and the respective circuitry in order to provide for such relative movement.

Additionally, a "paper in" switch 268 is provided in the form of an optical sensor to determine whether or not there is any paper actually in the throat 85 of the trough 80. The paper could be in or out of the trough and not moving. Accordingly, the optical encoder wheel 266 would not be turning thereby preventing the optical encoding of information by the paper movement detector 262. As a consequence, there is a double check by the "paper in" switch 268 as to the paper both being in the trough 85, and as to the fact of whether or not it is moving by means of the rotation of the wheel 266 of the optical encoder of the paper movement detector 262.

Figure 12:
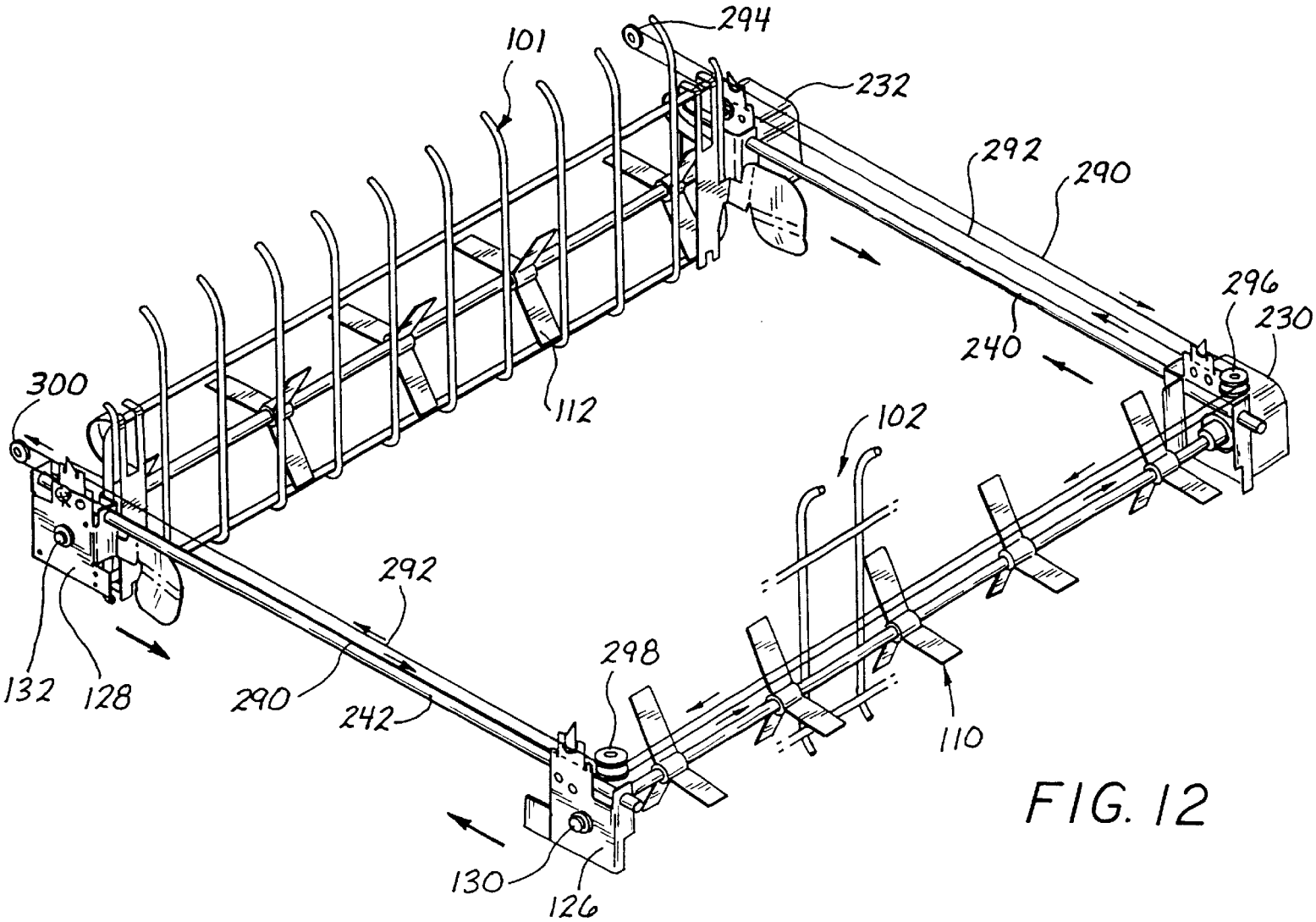
FIG. 12 shows a broken out partial perspective view of the fences comprising a portion of the paper stacker of this invention with the paddles.

Looking more particularly at the showing of FIG. 12, it can be seen that the fences 101 and 102 as part of a basket are shown. The fences 101 and 102 are moveable fore and aft or inwardly and outwardly as previously stated on the shafts 240 and 242. This accommodates variously sized paper sheets 30. These shafts 240 and 242 allow the motors respectively 232 and 230 to be moved with their respective flexible paddles, 110 and 112 inwardly and outwardly along the shafts 240 and 242. This allows for relative movement not only of the motors 230 and 232 but also the coordinated movement of the fences 101 and 102 with the flexible paddles 110 and 112. Thus fore and aft directional movement and variable sized stacking can be accommodated with proper alignment. Also, it should be noted that the bearing supports 126 and 128 are shown holding the paddle shafts and the ends 130 and 132 of the shafts.

The inward and outward coordinated movement of the entire combination or structure of FIG. 12 is aligned and moves uniformly. A cable system comprising cables 290 and 292 wrap around the respective ends where the fences 102 and 101 move inwardly and outwardly along the shafts 240 and 242. The movement of the cables is uniform so that as the cables move in one direction, the opposite cable retracts or extends around the multiple pulleys or sheaves 294, 296, 298, and 300. This allows for uniform expansion and contraction and aligned expansion and contraction of the fences 101 and 102 with the flexible paddles 110 and 112, and of course the attendant motors 230 and 232 which drive the paddles. The coordinated movement of the fences 101 and 102 maintains a generally uniformly formed basket for receipt of the paper sheets 30.

Figure 6:
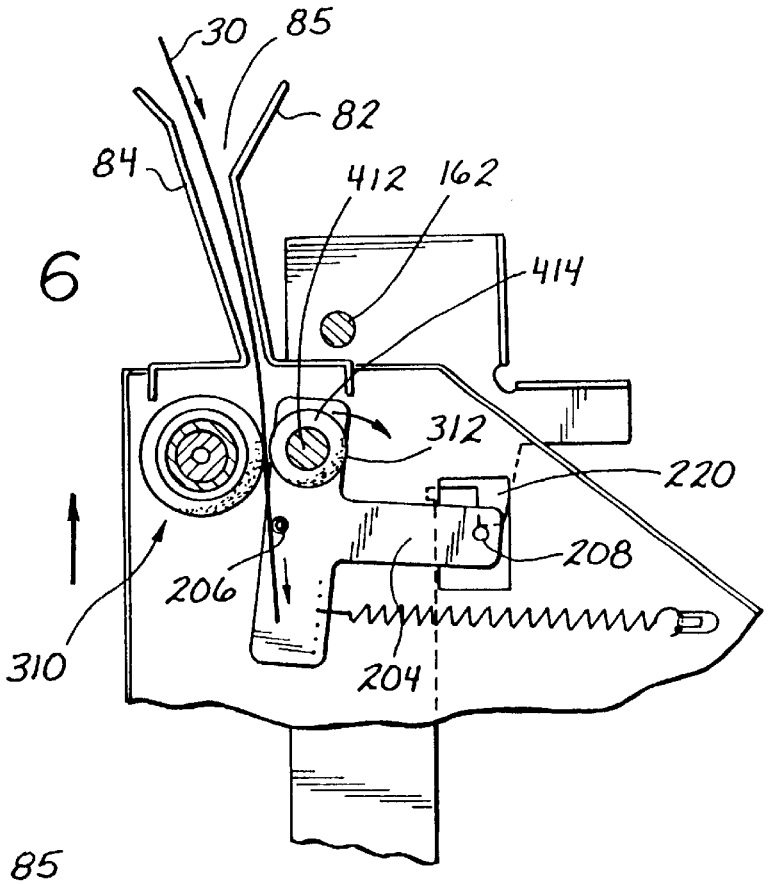
FIG. 6 shows a side elevation view of the rollers that form the pinch rollers in an opened position receiving the paper.
Figure 7:
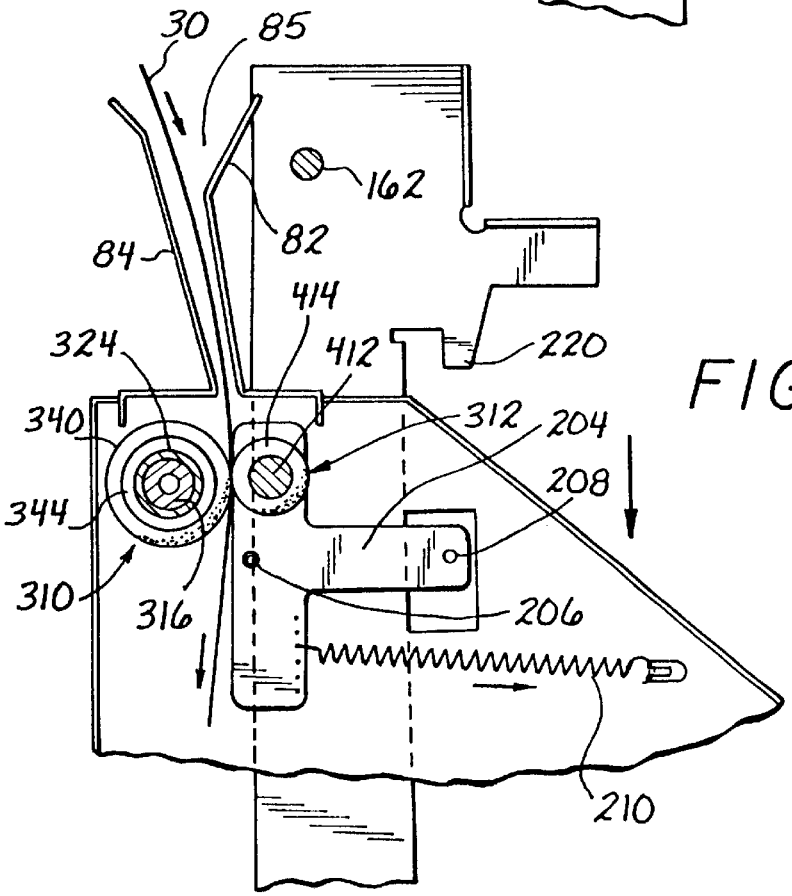
FIG. 7 shows a side elevation view of the paper being fed through the pinch rollers.

Looking more particularly at FIGS. 6 and 7, it can be seen that a pair of pinch rollers are shown in the form of drive rollers and shaft assembly 310, and idler rollers and assembly 312. The drive roller assembly 310 and idler rollers and assembly 312 serve to pinch, nip or engage the paper 30 as it passes from the throat 85 of the trough comprising trough sides 82 and 84. The rollers nip the paper as can be seen in FIG. 7 in order to drive it. This is effected by the movement of the drive rollers of assembly 310 as will be expanded upon. The drive roller assembly 310 is driven by the motor 260 to which the shaft is connected to, while idler roller assembly 312 is left to idle against the drive rollers.

The idler roller assembly 312 is connected to the pivot plate 204 or bell crank. It is journaled by its shaft for rotational movement. The shaft as described hereinafter is connected thereto and allowed to move inwardly and outwardly against the drive rollers as seen in the direction of the articulated movement in FIGS. 6 and 7. The pivoting movement is around the pivot point 206 which is spring biased by spring 210.

In order to actuate or open the space between the rollers of roller assemblies 310 and 312, the pivot plate or bell crank 204 moves upwardly against the depending members 220 and 222. This causes a driving against pin 208 so that it moves the idler roller assembly 312 backwardly away from the drive roller assembly 310. The showing of FIG. 6 is with the frame run up to the top of the stanchions 153 and 176. The bell crank pins 208 engage the depending members 220 and 222 to allow for the opening of the rollers by means of the idler roller assembly 312 extending away from the drive roller assembly 310. When the frame is lowered on the stanchions 153 and 176, the spring biasing of spring 210 moves the idler assembly 312 backwardly against the drive roller assembly 310 in order to engage or nip the paper 30 so that it can then feed it in the manner described hereinafter.

Figures 9, 10:
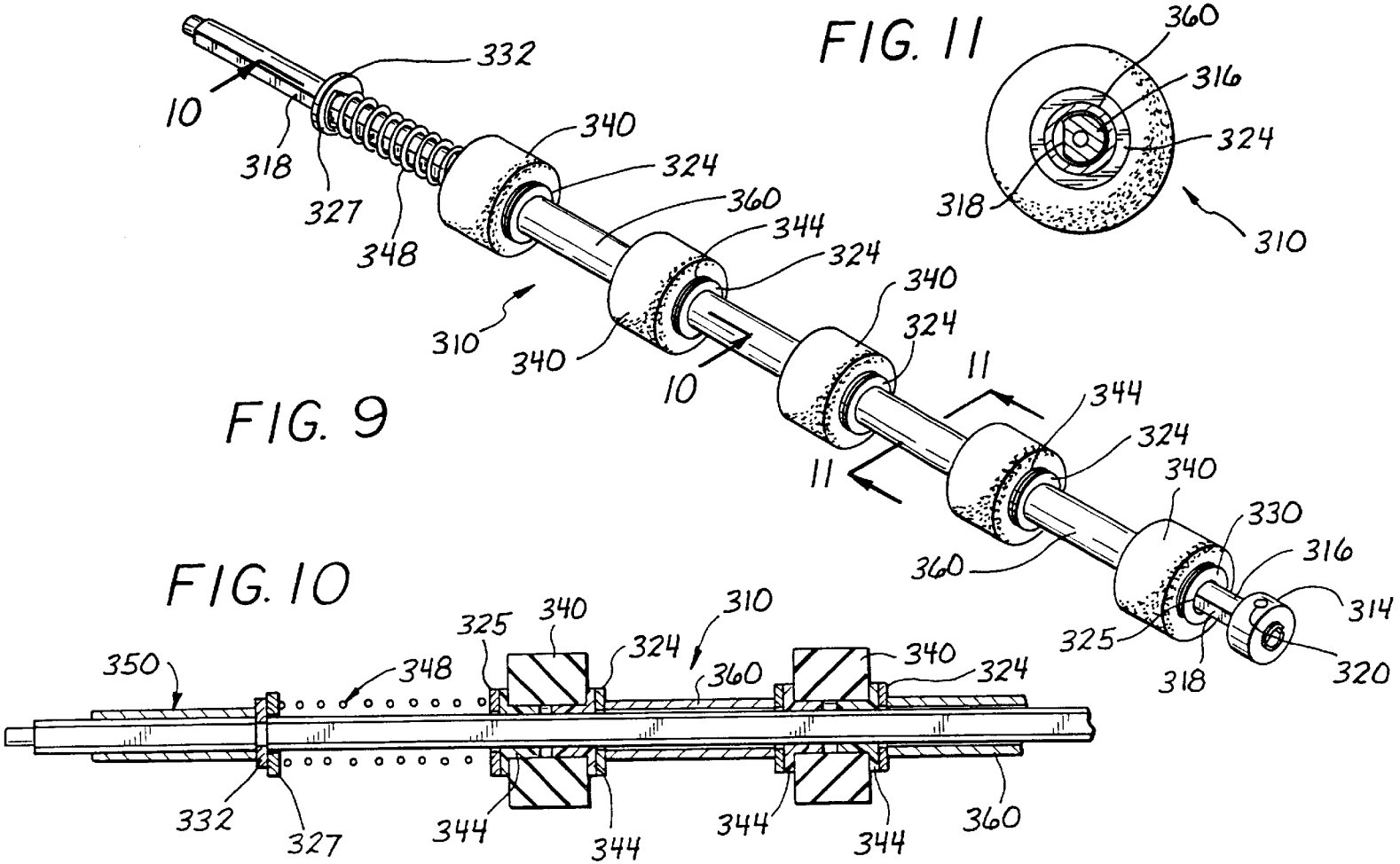
FIG. 9 shows a perspective view of the drive roller assembly.
FIG. 10 shows a midline sectional view of the drive roller assembly in the direction of line 10 of FIG. 9.

Looking more particularly at the roller assemblies 310 and 312 and the respective shafts upon which they are supported, it can be seen in FIGS. 9, 10 and 11 that a drive shaft 316 has been shown. The drive shaft 316 is driven by the drive motor 260 having the output shaft of the drive motor connected to a collar 314. The collar 314 connects the motor shaft of motor 260 to the drive shaft 316. The drive shaft 316 has a flat 318 that can be seen as the flat at one end 318 and at the other end passing along the length of the shaft. The flat 318 can also be seen in the cross-section in greater detail in FIG. 11. The shaft 316 with the collar 314 has a set screw 320 which allows the collar to be set and engage the output shaft of the motor 260. Thus, the output shaft of the motor 260 can directly turn the shaft 316 with the flat 318.

The drive shaft 316 with the flat 318 engages a plurality of friction washers, plates or engagement members 324 which are seen along the shaft. These friction washers or plates 324 also incorporate a flat on the interior side thereof. This flat on the interior side of the washers 324 engages the flat 318 of the shaft 316.

The friction washers or plates 324 and other portions of the assembly 310 are secured on the shaft and retained by a retaining ring 330 at the first end near the collar 314 and by a separate retaining ring 332 at the other end. These respective retaining rings are such wherein they hold the rollers on the shaft as will be described hereinafter, and comprise well known C type retaining rings which frictionally engage the shaft 316 around its circumference.

The drive rollers are comprised of low inertia rollers 340 spaced along the shaft 316. These rollers 340 are of a low density plastic foam like material within the range of 25 pounds per cubic foot of density. The density of the rollers 340 can be in any range so long as they are of low inertia and do not engage the paper with a high inertia tight engagement so as to rip the paper or overdrive it during the operation of the rollers. When referring to low density, the range of 20 pounds to 30 pounds per cubic foot is acceptable. The low inertia rollers 340 in this case are formed of a low wear abrasion resistant plastic polyurethane foam. They provide a high coefficient of friction against the paper so as to avoid slipping and smudging against the paper thus when positively driven they tend to drive and pull the paper 18.

In order to secure the rollers 340 on the shaft 316 and maintain them in operational rotational engagement, a plastic bushing 344 is used. The plastic bushing 344 engages the interior of the roller 340. When the bushing is inserted it holds the rollers 340 by virtue of the pressure exerted therein along the shaft. The pressure is exerted through a coil spring 348 which exerts a longitudinal force along the shaft 316 by being driven against a friction washer 325 analogous to friction washer or plates 324.

The spring constant of spring 348 establishes the amount of the friction imposed by the friction washers or plates 324 against the bushings 344. In some cases, it is desirable to have an adjustable screw member such as screw member 350 shown only in FIG. 10 which can be adjusted against the retainer ring 332 and against a washer 327 at the end analogous to friction washers 324. This serves to change the compression of the coil spring 348 so that it can exert more or less pressure longitudinally against the respective friction washers or plates 324.

The friction washers 324, low inertia driver rollers 340 and plastic bushings 344, are spaced along the shaft 316 by means of spacers, collars, tubes, or hollow cylinders 360 that are shown along the length thereof. These spacers or tubes 360 allow for the spacing of the assembly 310 along the length of shaft 316 and secure the assembly in its tightened juxtaposition for purposes of engaging the respective low inertia rollers 340 so that they move in a properly driven manner.

It should be born in mind that the low inertia rollers 340 are driven by the bushings 344 which engage them securely. A frictional slip is provided between the friction washers or plates 324 and the bushings 344 at their faces. This accommodates the variable amount of slip that is desired or necessary so that the rollers do not tear or damage the paper 18 as the drive rollers or low inertia rollers 340 are turned. In effect the amount of pressure between washers 324 and bushing surfaces of bushings 344, provide the slippage and drive in a system in the assembly 310 that is driven faster than the printed paper emerging speed of the paper 18 emerging from the throat 85.

The net result of the driving of the low inertia rollers 340 by means of turning the shaft 316 at a higher rate of speed than the emerging paper speed is to drive the rollers 340 at a speed that places the paper 18 in tension. In effect, the rollers 340 allow for a high co-efficient engagement of the paper in a pulling manner by being driven positively against the movement of the paper by the shaft 316. Any differentiation in the system is taken up by the engagement of the bushings 344 against the friction washers or plates 324. In effect, there is a clutch slipping action between the respective bushings 344 and plates 324 to constantly drive the rollers 340 against the paper to place it in tension while at the same time not tearing it. The rollers 340 will not tend to pull and tear the paper inasmuch as any force exerted against them will be dissipated in the slippage between the bushing 344 and the plates 324.

Looking more particularly again at FIGS. 6 and 7, it can be seen that the idler roller assembly 312 is shown. The idler roller assembly 312 is journaled and supported with bearings on the bell crank or pivot plate 204. The idler roller assembly 312 also incorporates a shaft 412 which supports hard plastic rollers 414 along the length thereof. These can be seen as the rollers in the various figures such as FIGS. 3 and 4. The rollers 414 are spaced by the same spacers in the form of tubes 416 analogous to and identical to the tubes 360 used as spacer tubes on the drive shaft 310. The idler rollers 414 are of a hard plastic material and can be formed of any suitable material such where they create sufficient engagement and nipping of the paper 18 against the low inertia drive rollers 340. Also, various combinations can be used in lieu of the drive rollers 340 and idler rollers 414 depending on the overall inertia desired of the drive rollers 340 and the drive factor between the idlers and the drive rollers.

Looking more particularly at FIG. 8, it can be seen wherein the movement of the stacker is shown with paper sheets 30 of the paper 18 being stacked on top of the tent 104 comprising a series of wires having an upper surface 105.

The flexible paddles 110 and 112 are shown moving around in order to push and wipe the fan folded edges of the paper sheets 30 downwardly near the fan folded perforations. The flexible paddles 110 and 112 are shown rotating and driven by their respective motors 230 and 232 and supported in bearings as previously stated. Also, it can be seen that the optical sensors 198 and 196 are shown with the entire frame so as to determine the orientation of where the edges of the paper sheets 30 are with regard to the entire frame 88. Also, it can be seen that the fences 102 and 101 are shown such where they can move inwardly and outwardly (i.e. fore and aft) on the shafts or rails 240 and 242.

The optical sensors 196 and 198 are placed so as to be slightly overlying the orientation of the paper. They are placed inwardly just slightly with regard to the fore and aft direction so that they can accommodate and determine the edge of the paper stack. Also, by being just above the level of the paper, they can determine the position of the paper sheets 30 as they are being stacked.

The orientation and placement of the sensors 196 and 198 adjusts to the fore and aft mode and the vertical mode of the paper placement. At the same time, the sensors accommodate the rotation of the flexible paddles 110 and 112. In order to do this, there is a 100 milliseconds time increment before the sensors and the logic circuit will either cause the frame 88 to move or in the alternative signal other particular required movement. In effect, the sensors are "debounced" by the logic circuit so as to eliminate movement due to the rotation of the flexible paddles 110 and 112 as they pass through the path of the sensors. At the same time, this also avoids movement based upon single sheets 30 passing through the sensor's path. Thus the frame 88 is not moved by the logic of the circuit until a time lapse has passed from the sensor sensing paper or paddle movement. This lag time or de-bouncing or what might be called a window of built in hysteresis between the time of sensing and required movement allows for an accommodation of the system to avoid unwarranted movement through the sensing of the paddle movement or a single sheet of paper crossing the optical path.

The fences 101 and 102 move inwardly and outwardly to allow for adjustment for variously sized lengths of paper sheets 30. These fences 101 and 102 can be considered fore and aft fences to allow for the boundary maintenance of the paper sheets 30 as they are being stacked. They also orient the paddles in conjunction therewith. The paddles turn through openings in the fences as can be seen.

The bell crank or pivotal member 204 is shown having been lowered from the upper position of the stanchions so that the drive roller 310 and idler roller 312 assemblies are shown driving the paper 18 passing therethrough downwardly.

A first pair of chains 460 and a second pair 462 are shown. The pairs of chains 460 and 462 are each comprised of two different lengths therein and allow the paper to be laid in a smooth manner with the catenary of the paper pushed fore and aft as it is laid down with the chains lying thereon. The chains can be a light chain like member of any suitable flexible configuration or a lightly weighted resting member such as a sheet or strip of metal so long as it engages the paper sheets 30 as they are is laid in their catenary formation.

For purposes of explanation, the pairs of chains 460 and 462 include a first chain ending at point 461, and a second chain ending at point 463. The second pair of chains 462 include a first chain ending at point 465 and a second chain ending at 67. In the side view of FIG. 8 they can not be seen as two chains inasmuch as they lie over each other and there is a plurality of pairs spaced within the length between the rollers.

The chains are allowed to rest on the tubular spacers 360 of the drive roller assembly 310 as well as the spacers 416 of the idler roller assembly 312. In this manner, they can oscillate backwardly and forwardly in order to allow for the paper to be gently coaxed downwardly through its catenary movement while at the same time the flexible paddles 110 and 112 turn the edges of the sheets 30 downwardly to place them within the orientation of the fences 101 and 102.

In conjunction with this operation, the optical sensors 196 and 198 through the logic and controls of the system signal the frame 88 to move upwardly and downwardly so that the frame can encapsulate and encompass the edges of the paper sheets 30 as they are being stacked upwardly. In this manner, the frame and fore and aft sensors 101 and 102 move upwardly as the stack or paper sheets 30 are being increased and maintain the stack in neat juxtaposition in a smoothly stacked manner.

From the foregoing, it can be seen that this invention is a significant step over the prior art for numerous reasons and should be accorded broad coverage in light of the following claims.

What is claimed is:

1. A paper stacker for use with a printer which prints a series of connected sheets that are to be stacked in a folded relationship after printing comprising:

a surface for receiving paper which has been printed and is to be stacked;

pinch rollers which feed the paper that has been printed having at least one drive roller and one idler roller for engaging and driving the paper therebetween;

said at least one drive roller is of a lesser density material than said at least one idler roller and is mounted on a bushing which is in turn mounted on a rotating shaft; and, a clutch for engaging said bushing to allow said bushing to slip on said shaft as it rotates.

2. The paper stacker as claimed in claim 1 further comprising;

said bushing on said shaft slips when the speed of the shaft exceeds the speed of the paper being fed through the pinch rollers so as to limit pulling tension on the paper.

3. The paper stacker as claimed in claim 1 wherein:

said clutch comprises a plate for engaging said bushing so as to apply a clutch surface between said bushing and said plate.

4. The paper stacker as claimed in claim 3 further comprising:

a spring adjustment for changing the pressure between said plate and said bushing so as to apply different clutch pressures.

5. A paper drive for use with a printer for printing a series of sheets that are to be stacked on a surface for receiving the paper comprising:

pinch rollers for receiving paper which has been printed to be placed on said surface, said pinch rollers comprising drive rollers and idler rollers between which the paper passes, wherein said drive rollers are of a lesser density than said idler rollers;

a drive shaft upon which said drive rollers are mounted;

a clutch surface for said drive rollers; and, a clutch plate mounted on said shaft for engaging said clutch surface so as to drive said drive rollers by said clutch surface with a slippage between the speed of the shaft and the drive rollers when the paper is being pulled at a pre-established pull rate.

6. The paper drive as claimed in claim 5 wherein:

said drive rollers are formed of a plastic material.

7. The paper drive as claimed in claim 6 wherein:

said drive rollers are formed of a plastic foam.

8. The paper drive as claimed in claim 6 wherein:

said clutch surface is formed as a bushing of said drive rollers.

9. The paper drive as claimed in claim 8 further comprising:

a spring biased engagement with said plate for causing said plate to engage the clutch surface of said drive roller.

10. The paper drive as claimed in claim 9 further comprising:

said spring bias is adjustable so as to provide for variable clutching forces between said plate and said clutching surface for said drive roller.

11. A paper stacker for use with a printer which prints a series of connected sheets that are to be stacked in a folded relationship after printing comprising:

a surface for receiving paper which has been printed upon and is to be stacked;

a drive shaft which is connected for rotational movement in order to drive paper in proximity thereto which has been printed upon;

at least one drive roller mounted on said drive shaft;

an idler roller for engaging paper between said idler roller and said drive roller;

a surface on said drive roller for slipping on said drive shaft;

a clutch surface in association with said drive roller; and, a clutch plate for engaging said drive roller mounted on said shaft so that as said shaft turns, it can turn said clutch surface in association with said drive roller.

12. The paper stacker as claimed in claim 11 further comprising:

said drive roller is formed of a plastic roam material.

13. The paper stacker as claimed in claim 11 further comprising:

said clutch surface in association with said drive roller is formed as a bushing upon which said drive roller is mounted; and, said plate driven by said drive shaft is placed in associated driving relationship to said bushing.

14. The paper stacker as claimed in claim 13 further comprising:

adjustment means for varying the clutching force between said plate and said clutch surface an said drive roller.

15. The paper stacker as claimed in claim 14 wherein:

said spring biasing means between said clutch plate and said clutch surface comprises a coil spring mounted around said shaft.

16. A paper drive for use with a printer for printing a series of sheets that are to be stacked comprising;

at least one first roller mounted on a shaft which is driven for rotational movement;

at least one second roller mounted on a shaft for idling with respect to said at least said first roller in rotational engagement therewith for receipt of a paper that is to be driven between said first roller and said second roller;

said first roller having a clutch surface; and, a clutch plate driven by said shaft upon which said first roller is mounted for rotating said first roller with slippage when said first roller is pulling the paper above a desired pulling rate.

17. The paper drive as claimed in claim 16 further comprising:

said first roller is mounted on a bushing which is in turn mounted on said shaft wherein said bushing provides a clutch surface for engaging said clutch plate.

18. The paper drive as claimed in claim 17 further comprising:

means for varying the pressure between said clutch surface and said clutch plate.

* * * * *